US008537415B2

(12) United States Patent
Okura et al.

(10) Patent No.: US 8,537,415 B2
(45) Date of Patent: Sep. 17, 2013

(54) INKJET PRINTER

(75) Inventors: Yuma Okura, Nagano (JP); Tetsuharu Ikeda, Nagano (JP); Takahiro Hasegawa, Nagano (JP); Masakazu Nakazawa, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 256 days.

(21) Appl. No.: 13/146,917

(22) PCT Filed: Jan. 30, 2009

(86) PCT No.: PCT/JP2009/051660

§ 371 (c)(1),
(2), (4) Date: Jul. 29, 2011

(87) PCT Pub. No.: WO2010/087013

PCT Pub. Date: Aug. 5, 2010

(65) Prior Publication Data

US 2011/0279867 A1 Nov. 17, 2011

(51) Int. Cl.
*G06K 15/22* (2006.01)

(52) U.S. Cl.
USPC ..... 358/1.3; 358/502; 358/1.12; 347/101; 347/102; 347/104; 347/105; 347/106; 347/108; 347/161

(58) Field of Classification Search
None
See application file for complete search history.

(56) References Cited

U.S. PATENT DOCUMENTS

| | | | | |
|---|---|---|---|---|
| 4,283,149 | A * | 8/1981 | Rethmeier | 400/617 |
| 4,788,587 | A * | 11/1988 | Bitoh | 358/502 |
| 6,168,260 | B1 * | 1/2001 | Yanagi et al. | 347/37 |
| 7,789,484 | B2 * | 9/2010 | Takada et al. | 347/37 |
| 7,948,650 | B2 * | 5/2011 | Takada et al. | 358/1.3 |
| 8,075,213 | B2 * | 12/2011 | Takada et al. | 400/636 |

FOREIGN PATENT DOCUMENTS

| | | |
|---|---|---|
| JP | S58-43652 | 3/1983 |
| JP | S60-026555 | 2/1985 |
| JP | H06-106895 | 4/1994 |
| JP | 2003-252501 | 9/2003 |
| JP | 2004-314565 | 11/2004 |
| JP | 2007-502724 | 2/2007 |
| JP | 2007-302468 | 11/2007 |
| JP | 2008-279621 | 11/2008 |

* cited by examiner

*Primary Examiner* — Hilina K Demeter
(74) *Attorney, Agent, or Firm* — Jianq Chyun IP Office

(57) ABSTRACT

In an inkjet printer, a feeding side tension applying means is provided with a feeding side tension adjustment mechanism, which is structured of a feeding side ballast arm that is extended toward a winding side tension applying means and vertically swingable around a rotation shaft perpendicular to a feeding direction of a printing medium and a feeding side ballast member that is attached to a tip end of the feeding side ballast arm, and a winding side tension applying means is provided with a winding side tension adjustment mechanism which is structured of a winding side ballast arm that is extended toward the feeding side tension applying means and vertically swingable around a rotation shaft perpendicular to the feeding direction of the printing medium "M" and a winding side ballast member that is attached to a tip end of the winding side ballast arm.

2 Claims, 8 Drawing Sheets

INKJET PRINTER

CROSS-REFERENCE TO RELATED APPLICATION

This application is a 371 of international application of PCT application serial no. PCT/JP2009/051660, filed on Jan. 30, 2009. The entirety of each of the Above-mentioned patent applications is hereby incorporated by reference herein and made a part of this specification.

BACKGROUND OF THE INVENTION

1. Technical Field

The present invention relates to an inkjet printer which performs printing on a printing medium in an elongated sheet shape.

2. Background Art

Conventionally, as an inkjet printer performing printing on a printing medium in an elongated sheet shape, an inkjet printer has been known which is structured so that a printing medium before printing is fed out by a feeding mechanism disposed on a rear side of a printer main body, ink is ejected while an inkjet head is relatively moved with respect to the printing medium to perform printing in the printer main body, and the printing medium on which printing has finished is wound by a winding mechanism disposed on a front side of the printer main body (see, for example, Patent Literature 1). In the inkjet printer described above, in order to appropriately feed out or wind up a printing medium without cockles and slackness, a tension applying mechanism which applies a predetermined tension to the printing medium may be provided on a feeding mechanism side or a winding mechanism side (see, for example, Patent Literatures 2 and 3).

A schematic structure of a conventional tension applying mechanism 200 is shown in FIG. 8(*a*). The tension applying mechanism 200 is structured of a medium arm 203, which is vertically swingable around a rotation shaft 204 that is perpendicular to a feeding direction of a printing medium "M", and a tension bar 201 which is supported by a tip end part of the medium arm 203 and extended in the perpendicular direction. The medium arm 203 is swung downward depending on its own weight and slackness of the printing medium "M" and thus the tension bar 201 is abutted with the printing medium so that the printing medium is bent and a tension is applied to the printing medium "M". Further, the tension applying mechanism 200 is arranged with a tension adjustment mechanism 300 which is structured of a ballast arm 301, which is vertically swingable around the rotation shaft 204 and extended in a direction on an opposite side to the tension applying mechanism, and a ballast member 302 which is attached to a tip end of the ballast arm 301. A tension which is applied to the printing medium "M" by the tension applying mechanism 200 is capable of being adjusted by a torque acting on the ballast arm 301 by the ballast member 302.

[Patent Literature 1] Japanese Patent Laid-Open No. 2007-302468

[Patent Literature 2] Japanese Patent Laid-Open No. 2008-279621

[Patent Literature 3] Japanese Patent Laid-Open No. 2003-252501

SUMMARY OF THE INVENTION

Technical Problem

As shown in FIG. 8(*a*), when the tension applying mechanism 200 and the tension adjustment mechanism 300 are disposed on both sides, i.e., on a feeding side and a winding side, the feeding side tension applying mechanism and the winding side tension applying mechanism are required to be largely separated from each other (with the distance "E") in the front and rear direction so that both of the tension adjustment mechanisms 300 are not interfered with each other. Therefore, the feeding side tension applying mechanism and the winding side tension applying mechanism are projected in the front and rear direction and thus the size of the inkjet printer is increased. In order to prevent this problem, as shown in FIG. 8(*b*), it is conceivable that the tension adjustment mechanism 300 is structured so that the ballast arm 301 is extended obliquely above. In this case, a distance between two tension applying mechanisms 200 can be narrowed to some extent in comparison with the above-mentioned case (distance "F" < distance "E"). However, further space saving (compacting) of the tension applying mechanism 200 and the tension adjustment mechanism 300 is required.

Further, in the inkjet printer, printing is performed on various types of printing medium and thus the tension applying mechanism 200 is required to apply a tension which is suitable for each of the printing media. Therefore, the tension adjustment mechanism 300 is provided and the tension applying mechanism 200 is structured so that a tension applied to a printing medium is adjustable by changing a weight of the ballast member 302. However, in order to cope with various types of printing medium, a structure is required in which a tension is capable of being adjusted in a further wider range.

In view of the problems described above, an objective of the present invention is to provide an inkjet printer in which, when a tension applying mechanism and a tension adjustment mechanism are provided on both sides, i.e., on a feeding side and a winding side, large space saving of the tension applying mechanism and the tension adjustment mechanism can be attained. Further, another objective of the present invention is to provide an inkjet printer in which a tension applied by a tension applying mechanism is adjustable in a further wider range.

Solution to Problem

In order to attain the above-mentioned objective, the present invention provides an inkjet printer including a printer main body which performs printing on a printing medium, a support body (for example, the support part 2 in the embodiment) which supports the printer main body, a medium feeding means for feeding out the printing medium in an elongated sheet shape toward the printer main body, a medium winding means for winding the printing medium which has been fed out by the medium feeding means and has been printed in the printer main body, a feeding side tension applying means which applies a tension to the printing medium which has been fed out by the medium feeding means and before reaching to the printer main body, and a winding side tension applying means which applies a tension to the printing medium which is fed out from the printer main body and before being wound by the medium winding means. The medium feeding means and the feeding side tension applying means are mounted on the support body on one side in a feeding direction of the printing medium with respect to the printer main body, and the medium winding means and the winding side tension applying means are mounted on the support body on the other side with respect to the printer main body. In addition, the feeding side tension applying means is provided with a feeding side tension adjustment mechanism which is structured of a feeding side ballast arm, which is extended toward the winding side tension applying means and mounted on the support body (for example, the rotation shaft support part 92 in the embodiment) so as to be vertically swingable around a rotation shaft perpendicular to the feeding direction of the printing medium, and a feeding side ballast member which is attached to a tip end of the feeding side ballast arm. The tension applied to the printing medium by the feeding side tension applying means can be adjusted by using a torque acting on the feeding side ballast arm by the feeding side ballast member. The winding side tension applying means is provided with a winding side tension adjustment mechanism which is structured of a winding side ballast arm, which is extended toward the feeding side tension applying means and mounted on the support body (for example, the rotation shaft support part 122 in the embodiment) so as to be vertically swingable around a rotation shaft perpendicular to the feeding direction of the printing medium, and a winding side ballast member which is attached to a tip end of the winding side ballast arm. The tension applied to the printing medium by the winding side tension applying means can be adjusted by using a torque acting on the winding side ballast arm by the winding side ballast member. The feeding side tension adjustment mechanism and the winding side tension adjustment mechanism are provided so as to displace from each other in the direction perpendicular to the feeding direction of the printing medium and are partly overlapped with each other in a side view where the feeding direction is a front direction.

Further, in order to attain the above-mentioned another objective, the present invention provides an inkjet printer including a printer main body which performs printing on a printing medium, a medium feeding means for feeding out the printing medium in an elongated sheet shape toward the printer main body, a medium winding means for winding the printing medium which has been fed out by the medium feeding means and has been printed in the printer main body, and a tension applying means which applies a tension to the printing medium which has been fed out by the medium feeding means and before being wound by the medium winding means. In addition, the tension applying means includes a tension applying mechanism which is provided with a tension arm (for example, the medium arms 93 and 123 in the embodiment) that is vertically swingable around a rotation shaft perpendicular to a feeding direction of the printing medium and in which a tip end of the tension arm swung downward by the own weight of the tension arm is abutted with the printing medium to apply the tension to the printing medium, a tension adjustment mechanism which is provided with a ballast arm that is vertically swingable around a rotation shaft perpendicular to the feeding direction and a ballast member that is attached to the ballast arm and in which the tension applied to the printing medium by the tension applying mechanism can be adjusted by using a torque acting on the ballast arm by the ballast member, and a switching mechanism (for example, the fixed rings 97 and 127, and the arm side protruded parts 98*a* and 128*a* of the ballast arms 98 and 28 in the embodiment) which is capable of switching between a first state in which, when the tension arm is swung to one side from a predetermined swing angle, the tension arm is engaged with the ballast arm for being capable of adjusting the tension by the tension adjustment mechanism, and a second state in which, when the tension arm is swung to the other side from the predetermined swing angle, the tension arm is separated from the ballast arm so that the torque by the tension adjustment mechanism is not operated.

Advantageous Effects Of Invention

In the inkjet printer in accordance with the present invention, the feeding side tension applying means is provided with a feeding side tension adjustment mechanism which is structured of a feeding side ballast arm, which is extended toward the winding side tension applying means and mounted on the support body so as to be vertically swingable around a rotation shaft perpendicular to the feeding direction of the printing medium, and a feeding side ballast member which is attached to a tip end of the feeding side ballast arm. Further, the winding side tension applying means is provided with a winding side tension adjustment mechanism which is structured of a winding side ballast arm, which is extended toward the feeding side tension applying means and mounted on the support body so as to be vertically swingable around a rotation shaft perpendicular to the feeding direction of the printing medium, and a winding side ballast member which is attached to a tip end of the winding side ballast arm. In addition, the feeding side tension adjustment mechanism and the winding side tension adjustment mechanism are provided so as to displace from each other in the direction perpendicular to the feeding direction of the printing medium and are partly overlapped with each other in a side view where the feeding direction is a front direction. Therefore, in comparison with the conventional case shown in FIGS. 8(*a*) and 8(*b*), remarkable space saving (compacting) of the feeding side tension applying means and the winding side tension applying means can be attained.

Further, in the inkjet printer in accordance with another present invention, the tension applying means includes a tension applying mechanism in which a tip end of the tension arm swung downward by the own weight of the tension arm is abutted with the printing medium to apply the tension to the printing medium, a tension adjustment mechanism in which the tension applied to the printing medium by the tension applying mechanism can be adjusted by using a torque acting on the ballast arm by the ballast member, and a switching mechanism which is capable of switching between a first state in which, when the tension arm is swung to one side from a predetermined swing angle, the tension arm is engaged with the ballast arm for being capable of adjusting the tension by the tension adjustment mechanism, and a second state in which, when the tension arm is swung to the other side from the predetermined swing angle, the tension arm is separated from the ballast arm so that the torque by the tension adjustment mechanism is not operated. According to this structure, a first state where the tension is capable of being adjusted by utilizing a torque acting on the ballast arm by the ballast member and a second state where the tension arm is separated from the ballast arm so that the tension is applied by the own weight of the tension arm can be switched to each other. Therefore, the tension can be adjusted in further wider range in comparison with the conventional tension applying means.

BRIEF DESCRIPTION OF THE DRAWINGS

FIG. 1 is a side view showing an inkjet printer in accordance with the present invention.

FIG. 2 is a perspective view showing the inkjet printer which is viewed from a front side.

FIG. 3 is a front view showing a main structure of a printer main body which structures the inkjet printer.

FIG. 4 is a plan view showing structures of a feeding side tension applying means and a winding side tension applying means.

FIGS. 5(*a*) and 5(*b*) are side views showing an operation of a feeding side tension applying means on an upper side with respect to an engagement start angle.

FIGS. 6(*a*) and 6(*b*) are side views showing an operation of a feeding side tension applying means on a lower side with respect to an engagement start angle.

FIG. 7 is a schematic view showing swing ranges of medium arms which are engaged with the feeding side tension adjustment mechanism and the winding side tension adjustment mechanism.

FIGS. 8(*a*) and 8(*b*) are side views showing structures of conventional tension applying means.

DESCRIPTION OF THE EMBODIMENTS

Figure 1:
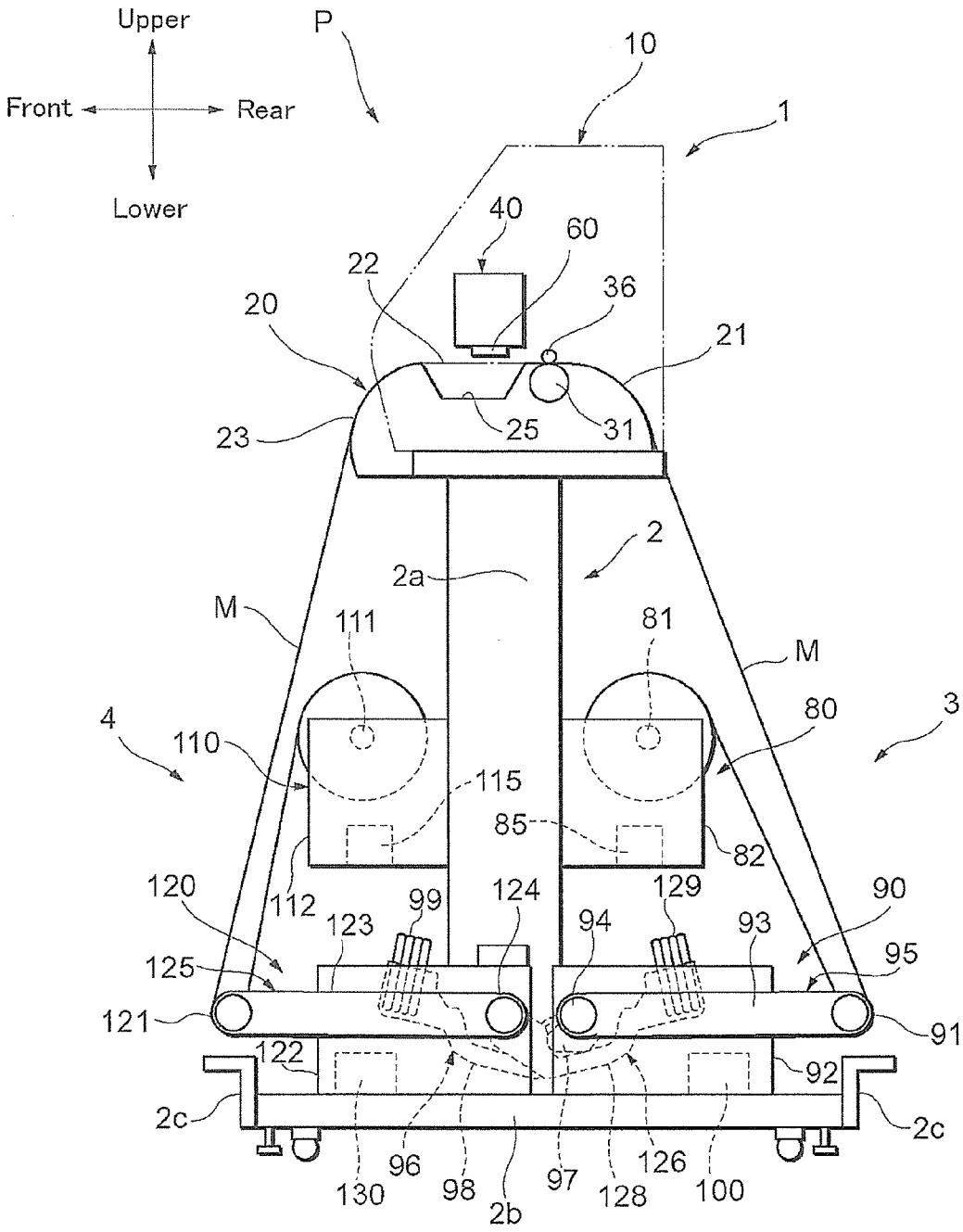
[FIG. 1]
Figure 2:
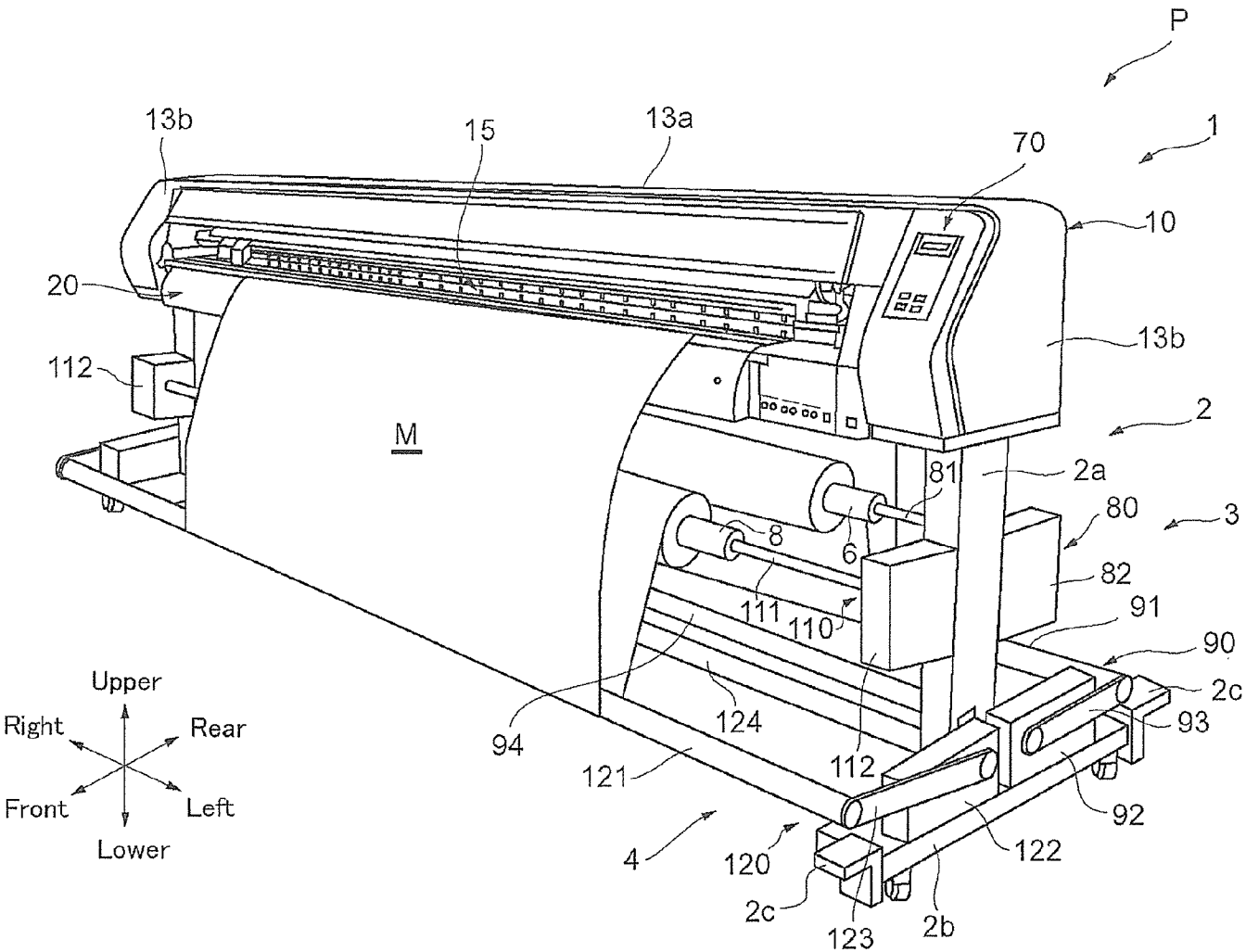
[FIG. 2]

A preferred embodiment of the present invention will be described below with reference to the accompanying drawings. As shown in FIGS. 1 and 2, an inkjet printer "P" in accordance with the present invention is structured of a printer main body 1 which performs printing on a printing medium "M", a support part 2 which supports the printer main body 1 at a height position where working is easily performed, a feeding device 3 for feeding out the printing medium "M" in an unprinted state to the printer main body 1, and a winding device 4 for winding the printing medium "M" on which printing has been finished. In the following description, directions in the drawings indicated by the arrows of front and rear, right and left, upper and lower are receptively referred to as a front and rear direction, a right and left direction and an upper and lower direction for convenience of description.

Figure 3:
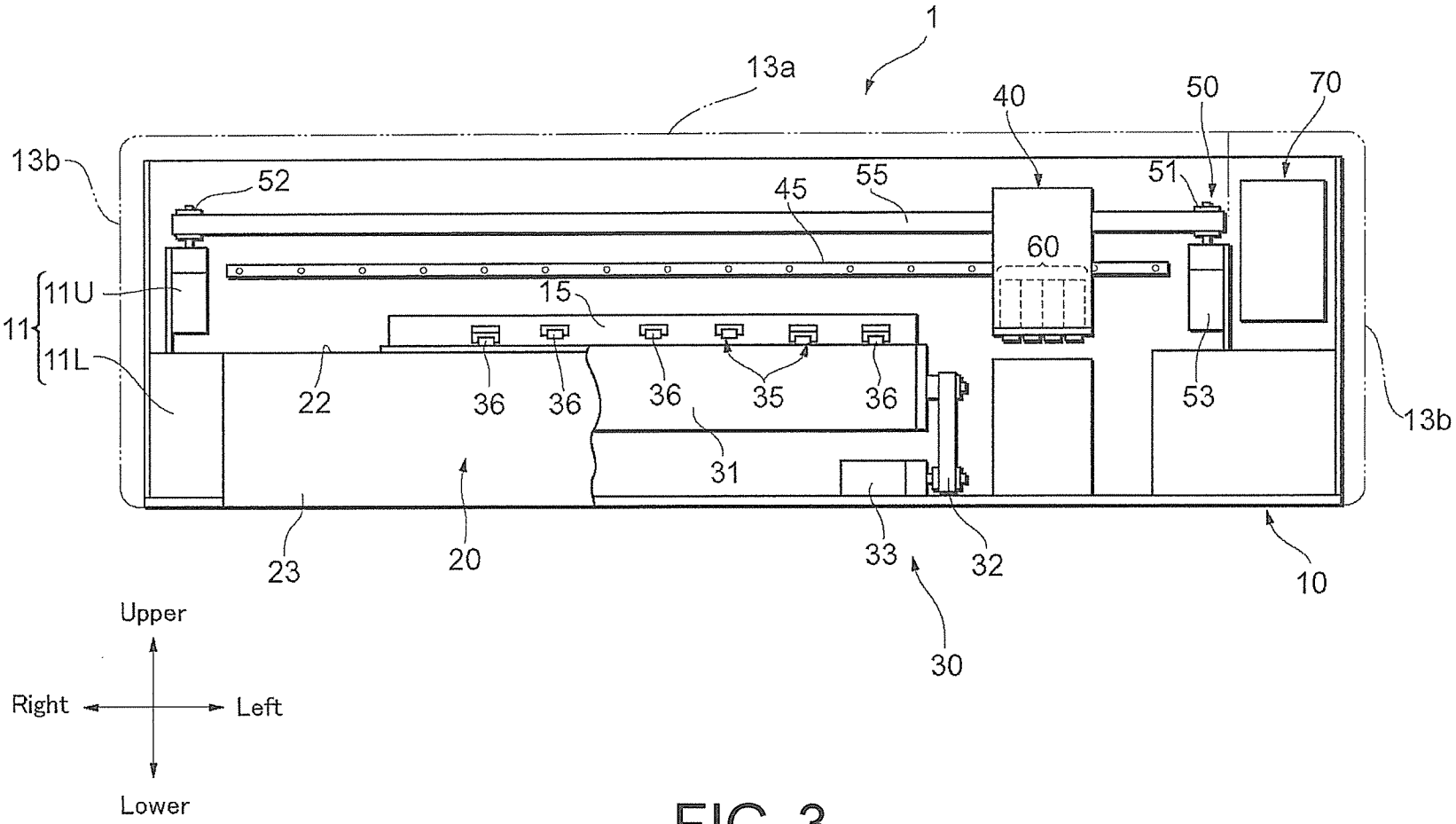
[FIG. 3]

First, the printer main body 1 will be briefly described below with reference to FIG. 3 which shows a main structure of the printer main body 1. The printer main body 1 is mainly structured of a body 10 which is a mounting base for respective units, a platen 20 which supports a printing medium "M", a medium moving mechanism 30 which moves the printing medium "M" supported on the platen 20 in a front and rear direction, a carriage 40 which is located above the platen 20 and is movably supported in a right and left direction, a carriage moving mechanism 50 which relatively moves the carriage 40 in the right and left direction with respect to the printing medium "M" that is supported by the platen 20, a plurality of inkjet heads 60 which are fixed to and supported by the carriage 40, and a printing controller 70 which controls the drives of the respective moving mechanisms 30 and 50, ink ejection from the inkjet heads 60 and the like.

The body 10 is provided with a main body frame 11 comprised of a lower frame 11L, which is supported by right and left supporting legs 2*a* structuring the support part 2 and on which the platen 20 is mounted, and an upper frame 11U on which a support structure for the carriage 40 is mounted. A medium passing part 15 formed in a laterally long window shape is formed between the upper frame 11U and the lower frame 11L so that a printing medium "M" is capable of passing through in the front and rear direction. The body 10 is surrounded by a front cover 13*a* which covers a center part of the main body frame 11 and side covers 13*b* which cover the right and left sides and is structured in a laterally long rectangular box-like shape as a whole.

The platen 20 is located at a center part in the right and left direction of the body 10 and provided over the front and rear sides of the medium passing part 15. The platen 20 is structured of a main platen 22, which is formed with a support face for horizontally supporting the printing medium "M" at a printing part (printing region) where the inkjet heads 60 are moved in the right and left direction to perform printing, a rear platen 21 which is extended backward from the main platen 22 and provided on a rear face side of the body 10, and a front platen 23 which is extended forward from the main platen 22 and provided on a front face side of the body 10. A rear end side of the rear platen 21 and a front end side of the front platen 23 are respectively extended downward in a smooth curved shape. A printing medium "M" which is fed out from the feeding device 3 and fed into the platen 20 is smoothly moved through respective upper faces of the rear platen 21, the main platen 22 and the front platen 23 in this order and then, the printing medium "M" is fed out from the front platen 23 and wound by the winding device 4.

The support face of the main platen 22 is formed with a large number of suction holes whose diameter is around several millimeters and a decompression chamber 25 which is capable of being set in a negative pressure is provided on a lower side of the support face. The printing medium "M" is sucked and held at the printing part by setting the decompression chamber 25 in a negative pressure and the position of the printing medium "M" is not displaced during printing.

The medium moving mechanism 30 is structured of a feed roller 31 formed in a cylindrical tube shape, which is rotatably provided around a rotation shaft extended in the right and left direction and disposed so that its upper peripheral face is exposed from the support face of the main platen 22, a roller drive motor 33 for rotatably driving the feed roller 31, a timing belt 32 which is stretched over a driven pulley coupled to a shaft end of the feed roller 31 and a drive pulley coupled to a shaft end of the roller drive motor 33, and a plurality of roller assemblies 35 which are provided with a pinch roller 36 that is rotatable in the front and rear direction and are disposed on an upper side of the feed roller 31 with a predetermined interval in the right and left direction.

The roller assembly 35 is structured so that the pinch roller 36 is capable of being displaced between a clamp position where the pinch roller 36 is elastically engaged with the feed roller 31 and an unclamp position where the pinch roller 36 is separated to an upper side of the feed roller 31. When the feed roller 31 is turned in a state that the roller assemblies 35 are set in the clamp position and a printing medium "M" is sandwiched between the upper and lower rollers 36 and 31, the printing medium "M" is carried in the front and rear direction by a feeding amount corresponding to a turning angle of the feed roller 31, in other words, by a feeding amount corresponding to a drive control signal which is outputted from the printing controller 70 to the roller drive motor 33.

The carriage 40 is supported to be movable in the right and left direction by the guide rail 45, which is attached to the upper frame 11U and extended in the right and left direction in parallel to the feed roller 31. The guide rail 45 is a support rail of a linear bearing. The carriage 40 is fixed to a slide block which is fitted to the guide rail 45 so as to be slidably supported in the right and left direction and the carriage 40 is moved in the right and left direction by the carriage moving mechanism 50.

The carriage moving mechanism 50 is comprised of a drive pulley 51 and a driven pulley 52 which are provided in the vicinities of right and left side ends of the guide rail 45, a carriage drive motor 53 for rotationally driving the drive pulley 51, and a timing belt 55 which is stretched over the drive pulley 51 and the driven pulley 52. The carriage 40 is connected and fixed to the timing belt 55. Rotation of the carriage drive motor 53 is controlled by the printing controller 70 and the carriage 40 is slidably moved (moved in a reciprocated manner) in the right and left direction by a feeding amount corresponding to a drive control signal which is outputted from the printing controller 70 to the carriage drive motor 53.

The inkjet head 60 is formed on its under face with a large number of nozzles for ejecting ink droplets and the inkjet head 60 is fixed and supported by the carriage 40 so that its under face (nozzle face) is separated from a printing medium "M" with a predetermined gap space (distance). Various types of arrangement structure of the inkjet head 60 have been proposed and an appropriate structure may be utilized. In this embodiment, a head structure is adopted in which inkjet heads 60 for four colors (for example, black, cyan, magenta and yellow) are juxtaposeqlly disposed in the right and left direction. Further, the carriage 40 is capable of moving upward and downward by a carriage up-and-down mechanism not shown and a gap between the nozzle face of the inkjet heads 60 and a printing medium "M" can be adjusted depending on a surface condition of the printing medium "M" or the like by utilizing the carriage up-and-down mechanism.

The printing controller 70 controls the drive of the roller drive motor 33 in the medium moving mechanism 30 to intermittently feed forward and position a printing medium "M" which is supported on the platen 20 and, in addition, synchronously controls the drive of the carriage drive motor 53 in the carriage moving mechanism 50 and ink ejection from the nozzles of the respective inkjet heads 60 to form image such as a character or a pattern corresponding to a printing program on the printing medium "M". In this case, a printing medium "M" in an unprinted state is fed out to the platen 20 by the feeding device 3 depending on a feeding amount of the printing medium "M" on the platen 20 by the medium moving mechanism 30, and the printing medium "M" that printing has finished and fed out from the platen 20 is wound by the winding device 4.

Next, the feeding device 3 and the winding device 4 will be described below. The feeding device 3 is, as shown in FIG. 1, provided on the rear side of the supporting part 2. The feeding device 3 is structured of a medium feeding means 80, which supports a feeding shaft 6 in a tube-like shape (see FIG. 2) around which a printing medium "M" in an unprinted state is wound and rotates the feeding shaft 6 for feeding out the printing medium "M", a feeding side tension applying mechanism 90 which applies a tension to the printing medium "M" which is fed out by the medium feeding means 80 and before being fed into the platen 20, and a feeding controller 100 which controls a feeding amount of the printing medium "M" by the medium feeding means 80.

The medium feeding means 80 is structured of a bar-shaped support shaft 81, which is inserted into the feeding shaft 6 and integrally rotatable together with the feeding shaft 6, shaft support parts 82 which are disposed at intermediate parts on the rear sides of the right and left supporting legs 2*a* for rotationally and detachably supporting the support shaft 81, and a shaft drive mechanism 85 which is provided in the inside of the left side shaft support part 82 for rotationally driving the support shaft 81. The shaft drive mechanism 85 is, for example, structured of a drive motor, a timing belt which is stretched over an output shaft of the drive motor and an end part of the support shaft 81, and the like. The shaft drive mechanism 85 rotationally drives the support shaft 81 depending on a drive control signal inputted from the feeding controller 100. A printing medium "M" in an unprinted state which is supported between the right and left shaft support parts 82 by the support shaft 81 is fed out toward the platen 20 (rear platen 21) with a feeding amount (at a feeding speed) corresponding to a rotation amount (rotation speed) of the support shaft 81.

Figure 4:
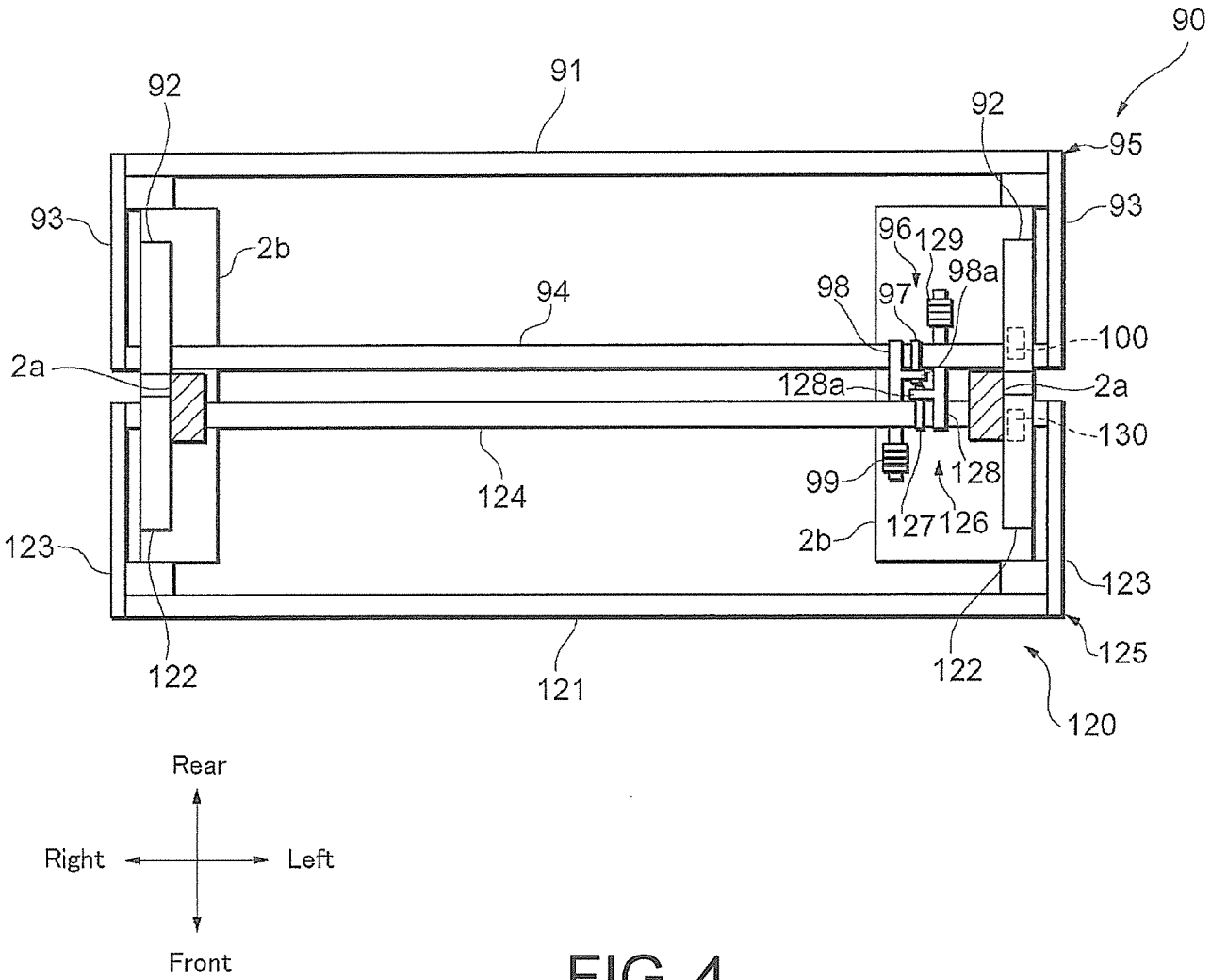
[FIG. 4]

The feeding side tension applying means 90 is, as shown in FIGS. 1 and 4, structured of a feeding side tension applying mechanism 95, a feeding side tension adjustment mechanism 96 and a fixed ring 97. The feeding side tension applying mechanism 95 is structured of a cylindrical bar-shaped tension bar 91, which is transversely abutted with the printing medium "M" in the right and left direction, rotation shaft support parts 92 which are disposed on bottom parts 2*b* of the right and left supporting legs 2*a*, a feeding side rotation shaft 94 which is rotationally supported by the right and left rotation shaft support parts 92, and a pair of right and left medium arms 93 whose base end parts are fixed to end parts of the feeding side rotation shaft 94 and whose tip end parts rotationally support end parts of the tension bar 91. The feeding side tension adjustment mechanism 96 is structured of a feeding side ballast arm 98 whose base end part is rotationally supported by the feeding side rotation shaft 94 and whose tip end part is detachably mounted with a feeding side ballast member 99. The fixed ring 97 is fixed to the feeding side rotation shaft 94 and integrally turned with the feeding side rotation shaft 94.

As described above, the base end parts of the medium arms 93 are respectively fixed to the right and left end parts of the feeding side rotation shaft 94 and the medium arms 93 are vertically swingable together with turning of the feeding side rotation shaft 94 with their base end parts as a center side. Further, the medium arms 93 are structured to be swung downward by their own weights so that the tension bar 91 supported at their tip end parts is abutted with a printing medium "M" which is fed out from the feeding shaft 6 and before reaching to the platen 20. In this embodiment, a swing angle detecting part (not shown) for detecting a swing angle of the medium arm 93, i.e., a height position of the tension bar 91 is disposed in the vicinity of the base end part of the medium arm 93. A detection signal which is detected by the swing angle detecting part is outputted to the feeding controller 100.

Figure 5A:
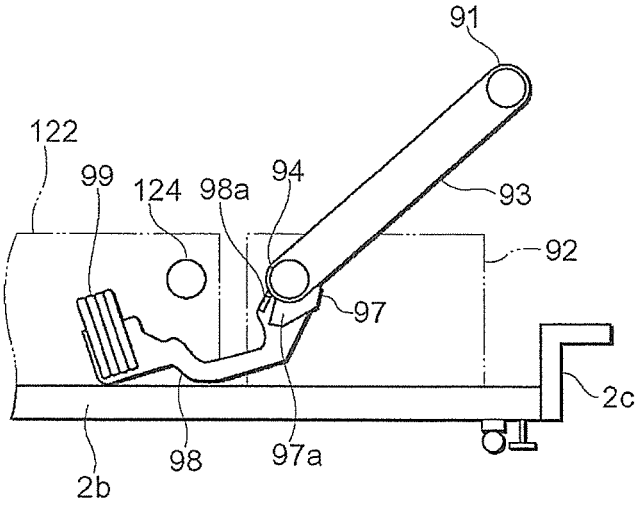
[FIG. 5]
Figure 5B:
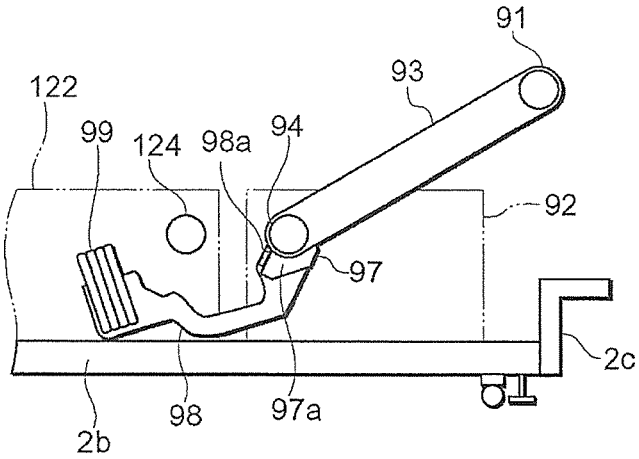

The fixed ring 97 is integrally turned with the feeding side rotation shaft 94 extended in the right and left direction, in other words, turned depending on swinging of the medium arm 93 which is fixed to the feeding side rotation shaft 94. The fixed ring 97 is formed with a ring side protruded part 97*a* which is protruded in a direction perpendicular to the feeding side rotation shaft 94. The ring side protruded part 97*a* is turned in a clockwise direction in a side view from the left side depending on a downward swing of the medium arm 93. When the medium arm 93 is reached to a predetermined swing angle (hereinafter, referred to as an engagement start angle), the ring side protruded part 97*a* begins to abut with an under face of an arm side protruded part 98*a* of the feeding side ballast arm 98 described below (see FIG. 5(*b*)). A state where the ring side protruded part 97*a* is abutted with the arm side protruded part 98*a* is referred to as an engagement state of the fixed ring 97 with the feeding side ballast arm 98, which will be described below.

A base end part of the feeding side ballast arm 98 is turnably supported by the feeding side rotation shaft 94 so as to be adjacent to the fixed ring 97 and the feeding side ballast arm 98 is formed to extend from the base end part to the front side so as to straddle and across the winding side rotation shaft 124 described below from the underside. The feeding side ballast arm 98 is provided so as to displace in the right and left direction (direction perpendicular to the feeding direction of a printing medium "M") from the winding side ballast arm 128 described below (see FIG. 4) and a part of the feeding side ballast arm 98 is disposed so as to overlap with the winding side ballast arm 128 when viewed from the side face (see FIG. 1). The feeding side ballast member 99 which is attached to the tip end part of the feeding side ballast arm 98 is located on a straight extended line which is connected between the feeding side rotation shaft 94 and the tension bar 91 in the side view when the fixed ring 97 and the feeding side ballast arm 98 are engaged with each other. The feeding side ballast member 99 is structured of a plurality of weight members which are respectively detachable at the tip end part of the feeding side ballast arm 98. The weight of the feeding side ballast member 99 can be changed by changing the number of the weight members.

An arm side protruded part 98*a* which is protruded to the fixed ring 97 side is formed in the vicinity of the base end part of the feeding side ballast arm 98. When the medium arm 93 becomes to be located at the engagement start angle as described above, the ring side protruded part 97*a* of the fixed ring 97 is abutted with the arm side protruded part 98*a* and the fixed ring 97 and the feeding side ballast arm 98 become in an engaging state. In the engaging state, in other words, when the medium arm 93 is swung on a lower side relative to the engagement start angle, the feeding side ballast arm 98 is vertically swung with its base end part (feeding side rotation shaft 94) as a center depending on swinging of the medium arm 93 (in conjunction with the medium arm 93) (see FIG. 6(*a*)). On the other hand, in a non-engaging state, in other words, when the medium arm 93 is swung on an upper side relative to the engagement start angle, the feeding side ballast arm 98 is abutted with a bottom part 2*b* of the supporting leg 2*a* to be in a stationary state (see FIGS. 5(*a*) and 5(*b*)).

Figure 6A:
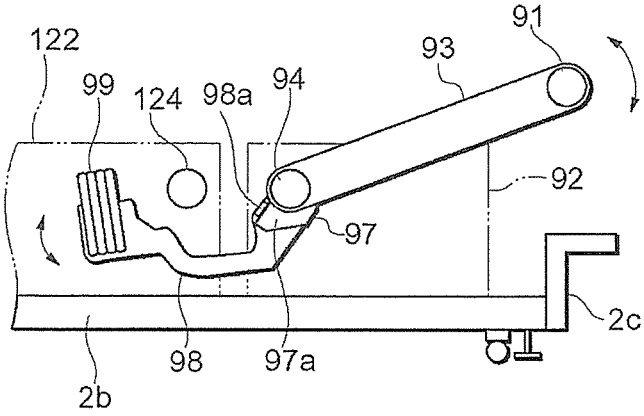
[FIG. 6]
Figure 6B:
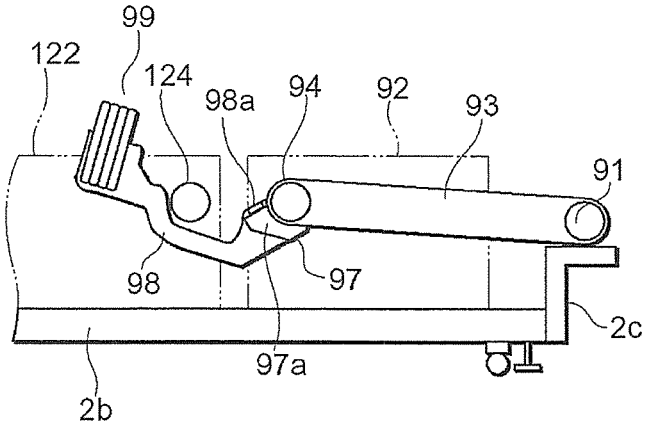

When the medium arm 93 is swung to a lower position than the engagement start angle to reach to a predetermined swing angle (hereinafter, referred to as a lower limit swing angle), a tip end of the medium arm 93 is abutted with a stopper member 2*c* provided in the bottom part 2*b* and a further downward swing of the medium arm 93 is restricted (see FIG. 6(*b*)). At this time, the feeding side ballast arm 98 and the winding side rotation shaft 124 are not abutted with each other.

In the feeding side tension applying means 90 which is structured as described above, the medium arm 93 is swung downward by the own weights of the tension bar 91 and the right and left medium arms 93 depending on a length of the printing medium "M" from the feeding shaft 6 before reaching to the platen 20 (hereinafter, referred to as slackness on the feeding side of the printing medium "M") and the tension bar 91 is abutted with an inner side of the printing medium "M" to bend the printing medium "M". In this manner, a tension corresponding to a height position of the tension bar 91, i.e., a swing angle of the medium arm 93 is applied to the printing medium "M" in a direction opposite to the feeding direction.

Figure 7:
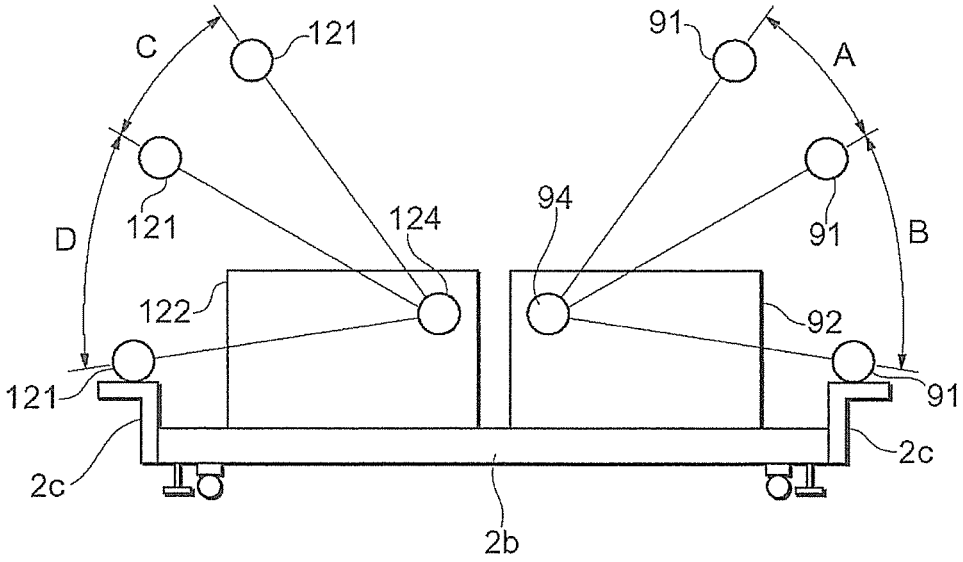
[FIG. 7]

In this case, when the medium arm 93 is swung on a lower side relative to the engagement swing angle (swing range "B" shown in FIG. 7), the fixed ring 97 and the feeding side ballast arm 98 are engaged with each other and the feeding side ballast arm 98 is interlocked with the medium arm 93. Therefore, a tension applied to the printing medium "M" can be adjusted by using a torque acting on the feeding side ballast arm 98 by the feeding side ballast member 99 (tension is reduced in comparison with the above-mentioned case). In this case, a tension suitable for the printing medium "M" to be printed can be applied to the printing medium "M" by changing the weight of the feeding side ballast member 99 depending on characteristics of the printing medium "M" (hardness and the like). Further, the feeding side ballast member 99 is disposed on one straight line formed with the tension bar 91 and the feeding side rotation shaft 94 in the side view through the feeding side ballast arm 98 and thus the weight of the feeding side ballast member 99 can be efficiently acted on the tension which is applied to the printing medium "M".

On the other hand, when the medium arm 93 is swung on an upper side relative to the engagement start angle (swing range "A" shown in FIG. 7), the fixed ring 97 and the feeding side ballast arm 98 are not engaged with each other. Therefore, the medium arm 93 is separated from the feeding side ballast arm 98 and thus a tension by the own weights of the tension bar 91 and the medium arms 93 is applied to the printing medium "M".

The feeding controller 100 is, as shown in FIGS. 1 and 4, disposed in the inside of the left side rotation shaft support part 92. The feeding controller 100 controls the drive of the shaft drive mechanism 85 in the medium feeding means 80 to feed out a printing medium "M" supported by the support shaft 81 with a predetermined feeding amount based on a feeding amount of the printing medium "M" on the platen 20 by the medium moving mechanism 30 (see FIG. 3). Further, the feeding controller 100 controls the feeding amount so that a swing angle of the medium arm 93 is maintained in a predetermined swing range. The predetermined swing range is capable of being set arbitrarily and, for example, when the swing range is set in the swing range "B", a tension applied to the printing medium "M" can be always set in an adjustable state by the feeding side tension adjustment mechanism 96.

The winding device 4 is, as shown in FIG. 1, provided on the front side of the supporting part 2. The winding device 4 is structured of a medium winding means 110, which supports a winding shaft 8 in a tube-like shape (see FIG. 2) around which the printing medium "M" after having been printed is wound and rotates the winding shaft 8 for winding the printing medium "M", a winding side tension applying means 120 which applies a tension to the printing medium "M" which is fed out from the platen 20 and before being wound by the medium winding means 110, and a winding controller 130 which controls a winding amount of the printing medium "M" by the medium winding means 110. In this embodiment, the winding device 4 is basically structured to be similar to the feeding device 3.

The medium winding means 110 is structured of a bar-shaped support shaft 111, which is inserted into the winding shaft 8 and integrally rotatable together with the winding shaft 8, shaft support parts 112 which are disposed at intermediate parts on the front sides of the right and left supporting legs 2*a* for rotationally and detachably supporting the support shaft 111, and a shaft drive mechanism 115 which is provided in the inside of the left side shaft support part 112 for rotationally driving the support shaft 111. The shaft drive mechanism 115 is, for example, structured of a drive motor, a timing belt which is stretched over an output shaft of the drive motor and an end part of the support shaft 111, and the like. The shaft drive mechanism 115 rotationally drives the support shaft 111 depending on a drive control signal inputted from the winding controller 130. The printing medium "M" having been printed which is fed out from the platen 20 (front platen 23) is wound around the winding shaft 8 that is supported between the right and left shaft support parts 112 through the support shaft 111 with a winding amount (at a winding speed) corresponding to a rotation amount (rotation speed) of the support shaft 111.

The winding side tension applying means 120 is, as shown in FIGS. 1 and 4, structured of a winding side tension applying mechanism 125, a winding side tension adjustment mechanism 126 and a fixed ring 127. The winding side tension applying mechanism 125 is structured of a cylindrical bar-shaped tension bar 121, which is transversely abutted with the printing medium "M" in the right and left direction, rotation shaft support parts 122 which are disposed on bottom parts 2*b* of the right and left supporting legs 2*a*, a winding side rotation shaft 124 which is rotationally supported by the right and left rotation shaft support parts 122, and a pair of right and left medium arms 123 whose base end parts are fixed to end parts of the winding side rotation shaft 124 and whose tip end parts rotationally support end parts of the tension bar 121. The winding side tension adjustment mechanism 126 is structured of a winding side ballast arm 128 whose base end part is rotationally supported by the winding side rotation shaft 124 and whose tip end part is detachably mounted with a winding side ballast member 129. The fixed ring 127 is fixed to the winding side rotation shaft 124 and integrally turned with the winding side rotation shaft 124.

As described above, the base end parts of the medium arms 123 are respectively fixed to the right and left end parts of the winding side rotation shaft 124 and the medium arms 123 are vertically swingable together with turning of the winding side rotation shaft 124 with their base end parts as a center side. Further, the medium arms 123 are structured to be swung downward by their own weights so that the tension bar 121 supported at their tip end parts is abutted with the printing medium "M" which is fed out from the platen 20 and before being wound by the winding shaft 8. In this embodiment, a swing angle detecting part (not shown) for detecting a swing angle of the medium arm 123, i.e., a height position of the tension bar 121 is disposed in the vicinity of the base end part of the medium arm 123. A detection signal which is detected by the swing angle detecting part is outputted to the winding controller 130.

The fixed ring 127 is integrally turned with the winding side rotation shaft 124 extended in the right and left direction, in other words, turned depending on swinging of the medium arm 123 which is fixed to the winding side rotation shaft 124. The fixed ring 127 is formed with a ring side protruded part (not shown) which is protruded in a direction perpendicular to the winding side rotation shaft 124. The ring side protruded part is turned in a counterclockwise direction in a side view from the left side depending on a downward swing of the medium arm 123. When the medium arm 123 is reached to a predetermined swing angle (hereinafter, referred to as an engagement start angle), the ring side protruded part begins to abut with an under face of an arm side protruded part 128*a* of the winding side ballast arm 128 described below. A state where the ring side protruded part is abutted with the arm side protruded part 128*a* is referred to as an engagement state of the fixed ring 127 with the winding side ballast arm 128, which will be described below.

A base end part of the winding side ballast arm 128 is turnably supported by the winding side rotation shaft 124 so as to be adjacent to the fixed ring 127 and the winding side ballast arm 128 is formed to extend from the base end part to the rear side so as to straddle and across the feeding side rotation shaft 94 from the underside. The winding side ballast arm 128 is provided so as to displace in the right and left direction (direction perpendicular to the feeding direction of the printing medium "M") from the feeding side ballast arm 98 (see FIG. 4) and a part of the winding side ballast arm 128 is disposed so as to overlap with the feeding side ballast arm 98 when viewed from the side face (see FIG. 1). The winding side ballast member 129 which is attached to the tip end part of the winding side ballast arm 128 is located on a straight extended line which is connected between the tension bar 121 and the winding side rotation shaft 124 in the side view when the fixed ring 127 and the winding side ballast arm 128 are engaged with each other. The winding side ballast member 129 is, similarly to the feeding side ballast member 99, structured of a plurality of weight members which are respectively detachable at the tip end part of the winding side ballast arm 128. The weight of the winding side ballast member 129 can be changed by changing the number of the weight members.

An arm side protruded part 128*a* which is protruded to the fixed ring 127 side is formed in the vicinity of the base end part of the winding side ballast arm 128. When the medium arm 123 becomes to be located at the engagement start angle as described above, the ring side protruded part of the fixed ring 127 is abutted with the arm side protruded part 128*a* and the fixed ring 127 and the winding side ballast arm 128 become in an engaging state. In the engaging state, in other words, when the medium arm 123 is swung on a lower side relative to the engagement start angle, the winding side ballast arm 128 is vertically swung with its base end part (winding side rotation shaft 124) as a center depending on swinging of the medium arm 123 (in conjunction with the medium arm 123). On the other hand, in a non-engaging state, in other words, when the medium arm 123 is swung on an upper side relative to the engagement start angle, the winding side ballast arm 128 is abutted with a bottom part 2*b* of the supporting leg 2*a* to be in a stationary state.

When the medium arm 123 is swung to a lower position than the engagement start angle to reach to a predetermined swing angle (hereinafter, referred to as a lower limit swing angle), a tip end of the medium arm 123 is abutted with a stopper member 2*c* provided in the bottom part 2*b* and a further downward swing of the medium arm 123 is restricted. At this time, the winding side ballast arm 128 and the feeding side rotation shaft 94 are not abutted with each other.

In the winding side tension applying means 120 which is structured as described above, the medium arm 123 is swung downward by the own weights of the tension bar 121 and the right and left medium arms 123 depending on a length of the printing medium "M" from the platen 20 before being wound by the winding shaft 8 (hereinafter, referred to as slackness on the winding side of the printing medium "M") and the tension bar 121 is abutted with an inner side of the printing medium "M" to bend the printing medium "M". In this manner, a tension corresponding to a height position of the tension bar 121, i.e., a swing angle of the medium arm 123 is applied to the printing medium "M" in the feeding direction.

In this case, when the medium arm 123 is swung on a lower side relative to the engagement swing angle (swing range "D" shown in FIG. 7), the fixed ring 127 and the winding side ballast arm 128 are engaged with each other and the winding side ballast arm 128 is interlocked with the medium arm 123. Therefore, a tension applied to the printing medium "M" can be adjusted by using a torque acting on the winding side ballast arm 128 by the winding side ballast member 129 (tension is reduced in comparison with the above-mentioned case). In this case, a tension suitable for the printing medium "M" to be printed can be applied to the printing medium "M" by changing the weight of the winding side ballast member 129 depending on types of the printing medium "M". Further, the winding side ballast member 129 is disposed on one straight line formed with the tension bar 121 and the winding side rotation shaft 124 in the side view through the winding side ballast arm 128 and thus the weight of the winding side ballast member 129 can be efficiently acted on the tension which is applied to the printing medium "M".

On the other hand, when the medium arm 123 is swung on an upper side relative to the engagement start angle (swing range "C" shown in FIG. 7), the fixed ring 127 and the winding side ballast arm 128 are not engaged with each other. Therefore, the medium arm 123 is separated from the winding side ballast arm 128 and thus a tension by the own weights of the tension bar 121 and the medium arms 123 is applied to the printing medium "M".

The winding controller 130 is, as shown in FIGS. 1 and 4, disposed in the inside of the left side rotation shaft support part 122. The winding controller 100 controls the drive of the shaft drive mechanism 115 in the medium winding means 110 to wind the printing medium "M" supported by the support shaft 111 with a predetermined winding amount based on a feeding amount of the printing medium "M" on the platen 20 by the medium moving mechanism 30 (see FIG. 3). Further, the winding controller 130 controls the winding amount so that a swing angle of the medium arm 123 is maintained in a predetermined swing range. The predetermined swing range is capable of being set arbitrarily and, for example, when the swing range is set in the swing range "D", a tension applied to the printing medium "M" can be always set in an adjustable state by the winding side tension adjustment mechanism 126.

Figure 8A:
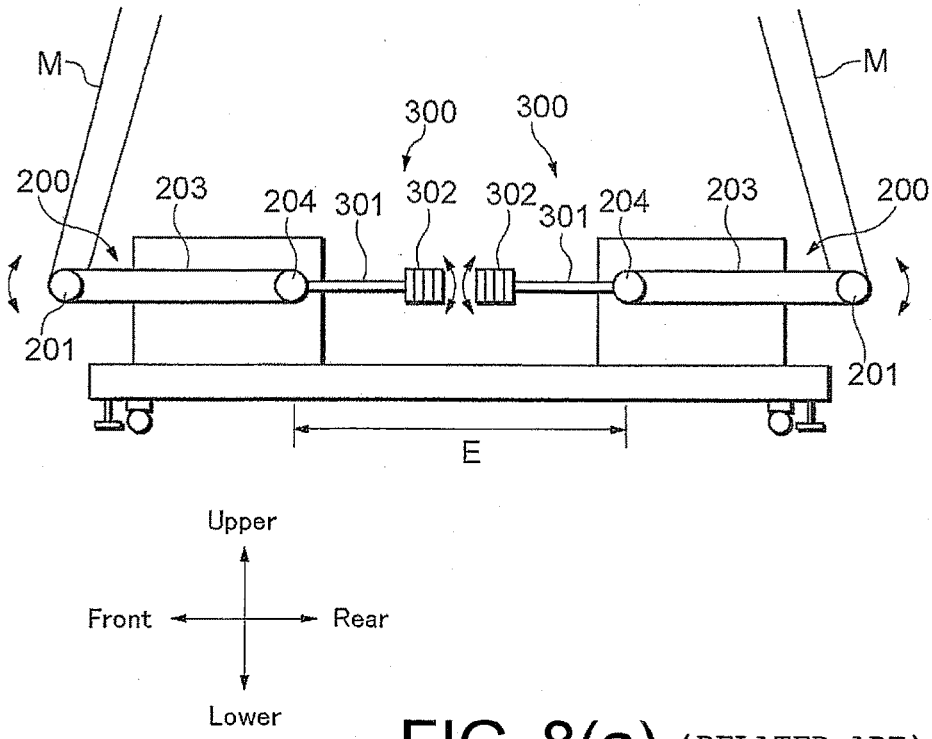
FIG. 8(a) (RELATED ART)
[FIG. 8]
Figure 8B:
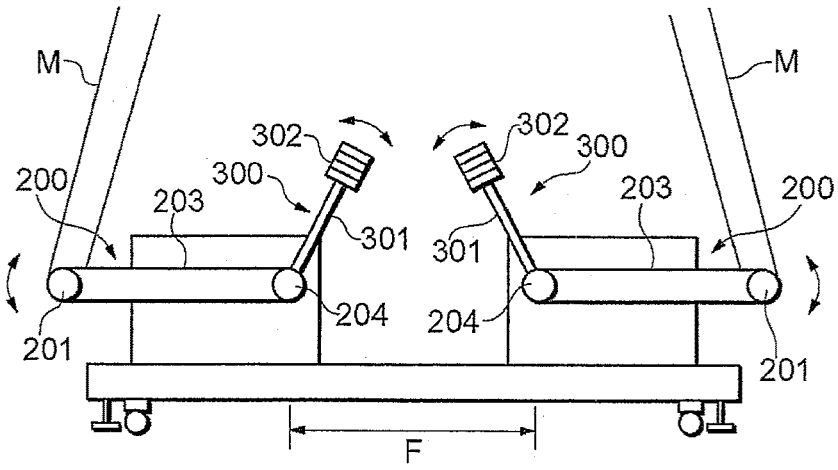
FIG. 8(b) (RELATED ART)

In the feeding side tension applying means 90 and the winding side tension applying means 120 which are structured as described above, the feeding side tension adjustment mechanism 96 (feeding side ballast arm 98) and the winding side tension adjustment mechanism 126 (winding side ballast arm 128) are provided so as to be displaced from each other in the direction (right and left direction) perpendicular to the feeding direction of the printing medium "M" and disposed so as to be partly overlapped with each other in the side view. Therefore, in comparison with the conventional feeding side and winding side tension applying means shown in FIGS. 8(*a*) and 8(*b*), the spaces for the feeding side tension applying means 90 and the winding side tension applying means 120 are largely reduced (their sizes can be remarkably reduced).

Further, depending on the swing angles of the medium arms 93 and 123, a state where the medium arms 93 and 123 are separated from the ballast arms 98 and 128 and tensions are applied to the printing medium "M" by the own weights of the tension bars 91 and 121 and the medium arms 93 and 123 can be switched to another state where the ballast arms 98 and 128 are moved in conjunction with the medium arms 93 and 123 so that tensions applied to the printing medium "M" are capable of being adjusted by utilizing torques acting on the ballast arms 98 and 128 through the ballast members 99 and 129, and vice versa. Accordingly, the tension can be adjusted in further wider range in comparison with the conventional tension applying means.

What is claimed is:

1. An inkjet printer comprising:

a printer main body which performs printing on a printing medium;

a support body which supports the printer main body;

a medium feeding means for feeding out the printing medium in an elongated sheet shape toward the printer main body;

a medium winding means for winding the printing medium which has been fed out by the medium feeding means and has been printed in the printer main body;

a feeding side tension applying means which applies a tension to the printing medium which has been fed out by the medium feeding means and before reaching to the printer main body; and a winding side tension applying means which applies a tension to the printing medium which is fed out from the printer main body and before being wound by the medium winding means;

wherein the medium feeding means and the feeding side tension applying means are mounted on the support body on one side in a feeding direction of the printing medium with respect to the printer main body;

wherein the medium winding means and the winding side tension applying means are mounted on the support body on the other side with respect to the printer main body;

wherein the feeding side tension applying means is provided with a feeding side tension adjustment mechanism which is structured of;

a feeding side ballast arm, which is extended toward the winding side tension applying means and mounted on the support body so as to be vertically swingable around a rotation shaft perpendicular to the feeding direction of the printing medium; and a feeding side ballast member which is attached to a tip end of the feeding side ballast arm;

wherein the tension applied to the printing medium by the feeding side tension applying means can be adjusted by using a torque acting on the feeding side ballast arm by the feeding side ballast member;

wherein the winding side tension applying means is provided with a winding side tension adjustment mechanism which is structured of;

a winding side ballast arm, which is extended toward the feeding side tension applying means and mounted on the support body so as to be vertically swingable around a rotation shaft perpendicular to the feeding direction of the printing medium; and a winding side ballast member which is attached to a tip end of the winding side ballast arm;

wherein the tension applied to the printing medium by the winding side tension applying means can be adjusted by using a torque acting on the winding side ballast arm by the winding side ballast member; and wherein the feeding side tension adjustment mechanism and the winding side tension adjustment mechanism are provided so as to displace from each other in the direction perpendicular to the feeding direction of the printing medium and are partly overlapped with each other in a side view where the feeding direction is a front direction.

2. An inkjet printer comprising:

a printer main body which performs printing on a printing medium;

a medium feeding means for feeding out the printing medium in an elongated sheet shape toward the printer main body;

a medium winding means for winding the printing medium which has been fed out by the medium feeding means and has been printed in the printer main body; and a tension applying means which applies a tension to the printing medium which has been fed out by the medium feeding means and before being wound by the medium winding means;

wherein the tension applying means comprises:

a tension applying mechanism which is provided with a tension arm that is vertically swingable around a rotation shaft perpendicular to a feeding direction of the printing medium and in which a tip end of the tension arm that is swung downward by own weight of the tension arm is abutted with the printing medium to apply the tension to the printing medium;

a tension adjustment mechanism which is provided with a ballast arm that is vertically swingable around a rotation shaft perpendicular to the feeding direction and a ballast member that is attached to the ballast arm and in which the tension applied to the printing medium by the tension applying mechanism can be adjusted by using a torque acting on the ballast arm by the ballast member; and a switching mechanism which is capable of switching between:

a first state in which, when the tension arm is swung to one side from a predetermined swing angle, the tension arm is engaged with the ballast arm for being capable of adjusting the tension by the tension adjustment mechanism, and a second state in which, when the tension arm is swung to the other side from the predetermined swing angle, the tension arm is separated from the ballast arm so that the torque by the tension adjustment mechanism is not operated.

* * * * *